US012232584B2

(12) United States Patent
Acosta

(10) Patent No.: US 12,232,584 B2
(45) Date of Patent: Feb. 25, 2025

(54) UMBRELLA BAG WITH WATER COLLECTOR

(71) Applicant: Rafael Acosta, Miami, FL (US)

(72) Inventor: Rafael Acosta, Miami, FL (US)

( * ) Notice: Subject to any disclaimer, the term of this patent is extended or adjusted under 35 U.S.C. 154(b) by 157 days.

(21) Appl. No.: 18/130,801

(22) Filed: Apr. 4, 2023

(65) Prior Publication Data

US 2024/0335015 A1 Oct. 10, 2024

(51) Int. Cl.

| | |
|---|---|
| ***A45B 25/28*** | (2006.01) |
| ***A45B 25/24*** | (2006.01) |
| ***A45B 25/26*** | (2006.01) |
| ***A45F 3/02*** | (2006.01) |

(52) U.S. Cl.

CPC ..... *A45B 25/28* (2013.01); *A45B 25/24* (2013.01); *A45B 25/26* (2013.01); *A45F 3/02* (2013.01); *Y10S 224/915* (2013.01)

(58) Field of Classification Search

CPC ..... A45B 25/26; A45B 25/24; A45B 25/28; A45F 3/02; Y10S 224/915

USPC ..... 135/34.2; 224/251, 258, 915

See application file for complete search history.

(56) References Cited

U.S. PATENT DOCUMENTS 294,622 A * 3/1884 Honinger ..... A45F 3/02 224/608
2,028,337 A * 1/1936 Lane ..... A47C 7/64 224/571
2,144,791 A * 1/1939 Burton ..... A63B 55/404 206/315.4
2,437,405 A * 3/1948 Robinson ..... A45F 3/02 206/315.3
3,526,238 A * 9/1970 Brayton ..... B60R 7/12 211/63
4,558,807 A * 12/1985 Jackson ..... A45B 25/24 224/258
4,810,102 A * 3/1989 Norton ..... A45F 5/02 150/108
5,112,068 A * 5/1992 Liao ..... A63B 55/60 280/DIG. 6
5,313,970 A * 5/1994 Hung ..... A45B 25/28 135/48
2006/0283905 A1* 12/2006 Wu ..... A45B 25/24 224/576
2013/0048692 A1* 2/2013 Chin ..... A45B 25/26 224/600
2013/0048693 A1* 2/2013 Chin ..... A45B 25/28 224/600
2013/0126571 A1* 5/2013 Field ..... A45B 25/26 224/613

FOREIGN PATENT DOCUMENTS

CA 2794899 A1 * 6/2013 ..... A45B 25/26

* cited by examiner

*Primary Examiner* — Robert Canfield
(74) *Attorney, Agent, or Firm* — Christopher J. Vandam, PA; Chris Van Dam

(57) ABSTRACT

A bag capable of holding a dry or wet umbrella without the risk of water spillage, while the user carries the bag keeping both hands free. In some embodiments, the bag may include features to facilitate its drying and to be carried in different positions by the user.

5 Claims, 10 Drawing Sheets

UMBRELLA BAG WITH WATER COLLECTOR

FIELD OF THE INVENTION

The present invention relates to novel umbrella carrying accessories. More particularly, the invention relates to umbrella bags that facilitate carrying dry or wet umbrellas without wetting the umbrella surroundings keeping the user's hands free while carrying the umbrella around.

BACKGROUND

Umbrellas are commonly carried by hand limiting the users' ability to use both hands for anything they might need to do. On rainy days, many stores and other facilities provide plastic bags at their entrance allowing customers to take wet umbrellas inside without wetting the floor to avoid risking slip and fall accidents. However, these plastic bags have some drawbacks. In some instances, the plastic bags break resulting in water spillage and the increased risk of slip and fall accidents. Additionally, these plastic bags must be carried by hand. This leads to the users having to put the plastic bag with the wet umbrella somewhere to be able to use their two hands, with the risk of forgetting the umbrella at the place it was put and therefore losing it.

Moreover, not all public places provide plastic bags for wet umbrellas. Instead, some venues have the only option of leaving the umbrellas in a common deposit at the entrance, with the consequent risk that the umbrella will be mistakenly taken by another customer when leaving the place. At some other locations, no option is offered to allow visitors to enter the premises with wet umbrellas.

Currently, there are a few models of umbrella bags available with limited functionality, which do not provide a solution to all the possible scenarios described herein. Therefore, the need exists for an umbrella bag that includes the functionalities required to solve all these problems.

BRIEF SUMMARY OF THE INVENTION

The present invention comprises a bag capable of holding a dry or wet umbrella with no risk of water spillage while the user carries the bag keeping both hands free, avoiding the need to put the bag with the umbrella elsewhere. In preferred embodiments of this invention, the bag includes two sleeves: an inner sleeve with a collector that stores the water drained by a wet umbrella, and an outer sleeve that supports the straps to carry the bag with the umbrella. The inner sleeve can be turned inside out to facilitate drying, and one of the straps attached to the outer sleeve can be adjusted in length and positioned in two different configurations so that the bag can be carried in several different ways by the user.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a", "an" and "the" are intended to include the plural forms as well as the singular forms, unless the context clearly indicates otherwise.

It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification should be read with the understanding that such combinations are entirely within the scope of the invention.

New bags for carrying umbrellas, their capabilities and features are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by referencing the appended figures representing preferred embodiments.

Figure 1A:
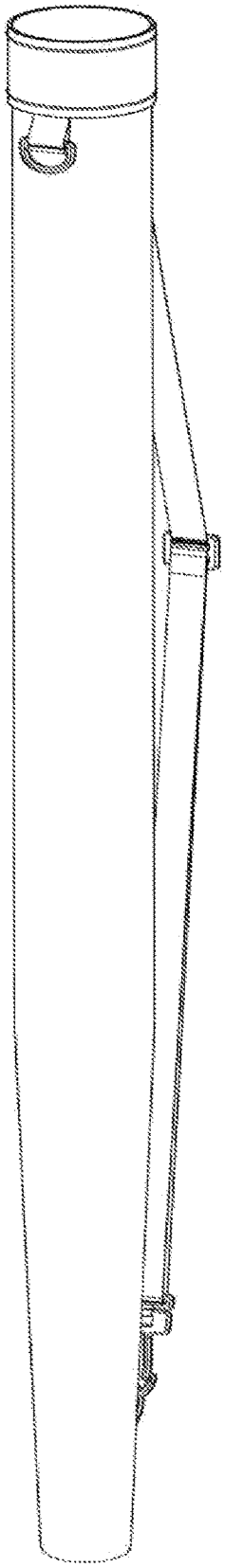
FIG. 1A depicts a perspective view of the front of one example of an Umbrella Bag with all its visible elements according to various embodiments of the present invention.
Figure 1B:
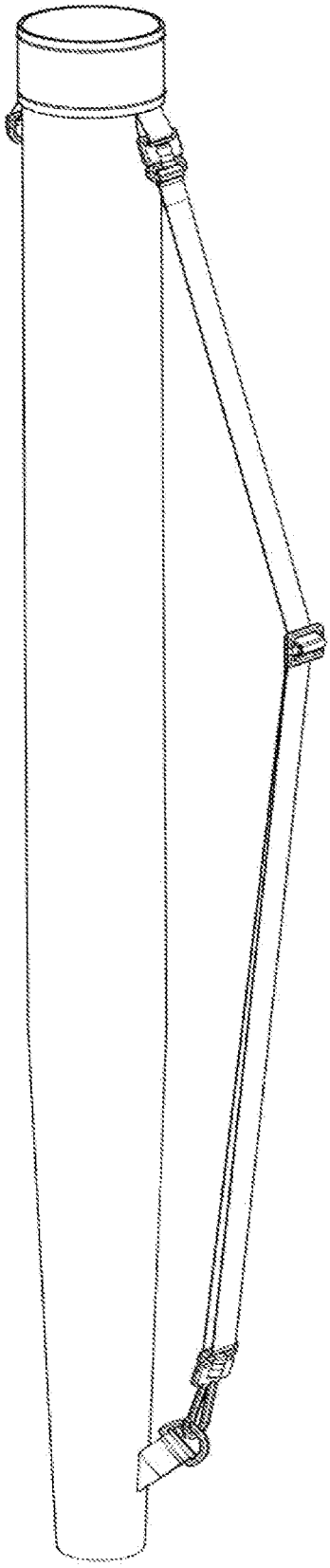
FIG. 1B depicts a perspective view of the back of one example of an Umbrella Bag with all its visible elements according to various embodiments of the present invention.

FIG. 1A depicts a perspective view of the front and FIG. 1B depicts a perspective view of the back of one example of an Umbrella Bag with Water Collector (the "Bag"), with all its visible elements according to various embodiments of the present invention. These figures show a Bag designed for long umbrellas. This Bag follows the geometric profile of the umbrella, having a cylindrical shape at its upper and middle sections, and a lower section with a cylindrical shape that gradually narrows in diameter towards its bottom. In preferred embodiments, the Bag's profile follows the geometric profile of one particular umbrella, however, the geometric profile of the Bag can be modified during manufacturing to accommodate umbrellas with different lengths and geometries.

Figure 2:
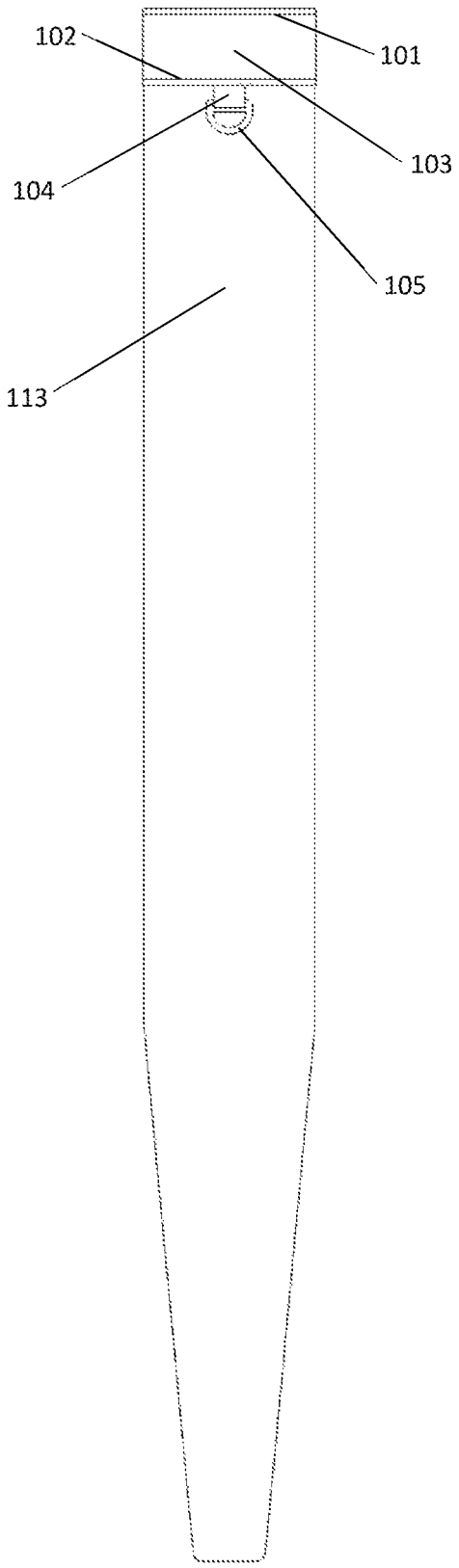
FIG. 2 depicts a front view of one example of an Umbrella Bag with all its visible elements according to various embodiments of the present invention.
Figure 3:
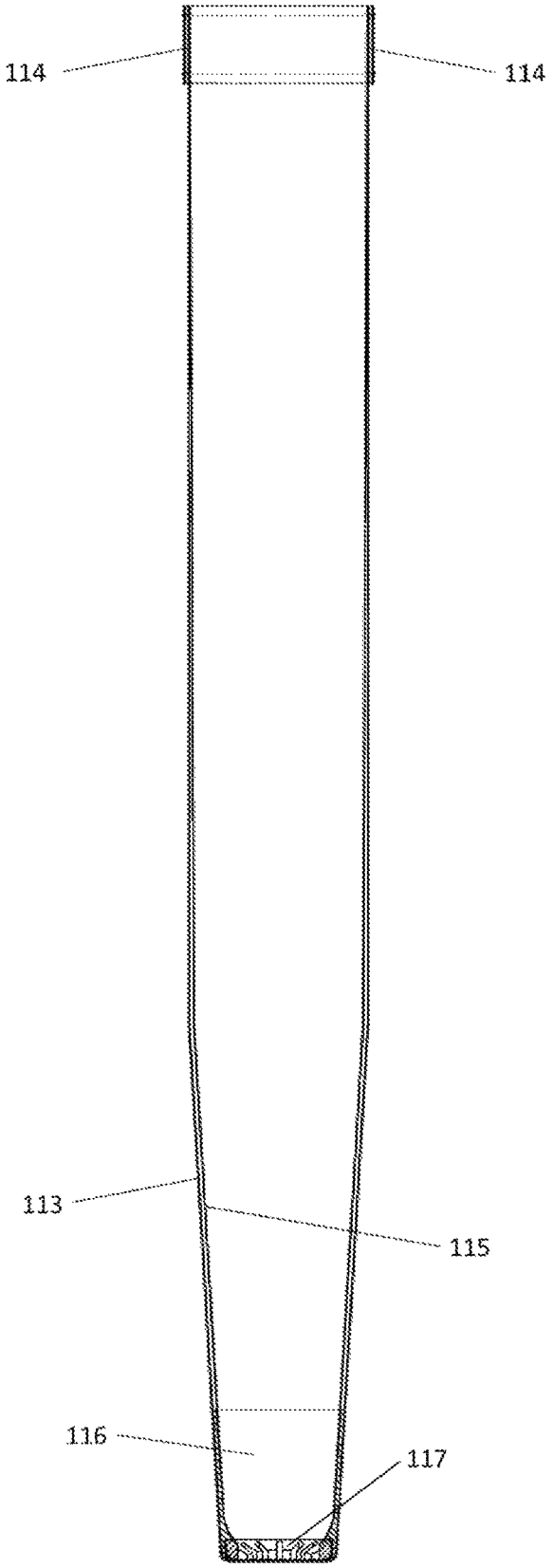
FIG. 3 depicts a section view of one example of an Umbrella Bag with all its internal elements according to various embodiments of the present invention.
Figure 4:
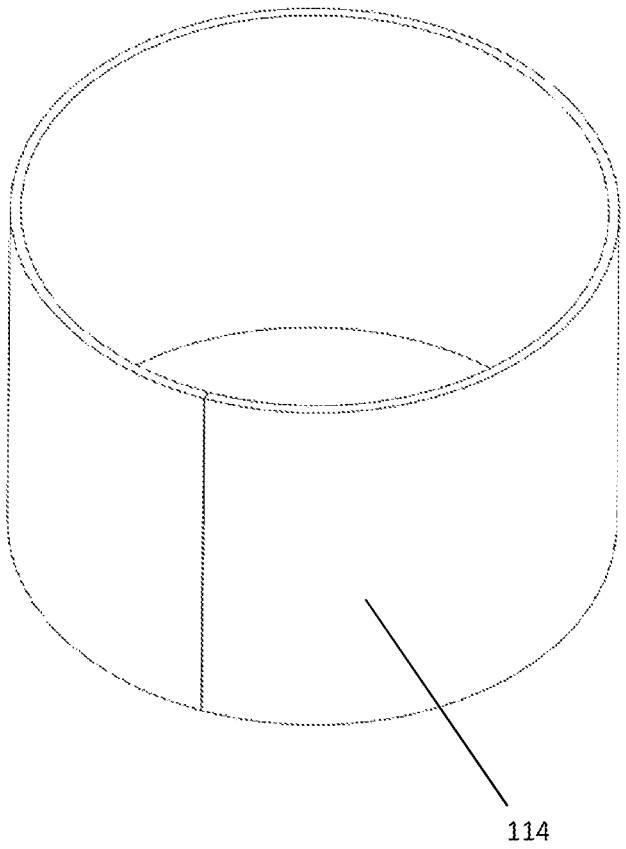
FIG. 4 depicts a perspective view of one example of a Neck Collar according to various embodiments of the present invention.

In preferred embodiments, the Bag comprises two sleeves made of waterproof fabric. The sleeves are put one inside the other and joined at the top by a seam to create an Outer Sleeve (113, FIG. 2) and an Inner Sleeve (115, FIG. 3). A cylindrical piece of material (the "Neck Collar", 114, FIG. 4) is placed around the top of the Outer Sleeve (113). The Outer Sleeve (113), the Inner Sleeve (115) and the Neck Collar (114), are then folded outwards to form a Neck (103, FIG. 2). The Outer Sleeve (113), the Inner Sleeve (115) and the Neck Collar (114) are joined by two seams, the Top Seam (101, FIG. 2) and the Bottom Seam (102, FIG. 2). The separation between the Top Seam (101) and the Bottom Seam (102) defines the length of the Neck (103) at the entrance of the Bag. The Neck Collar (114) may be made of a flexible material sturdy enough so that the Neck (103) at the entrance of the Bag does not deform easily when an umbrella is introduced into the Bag.

Figure 5A:
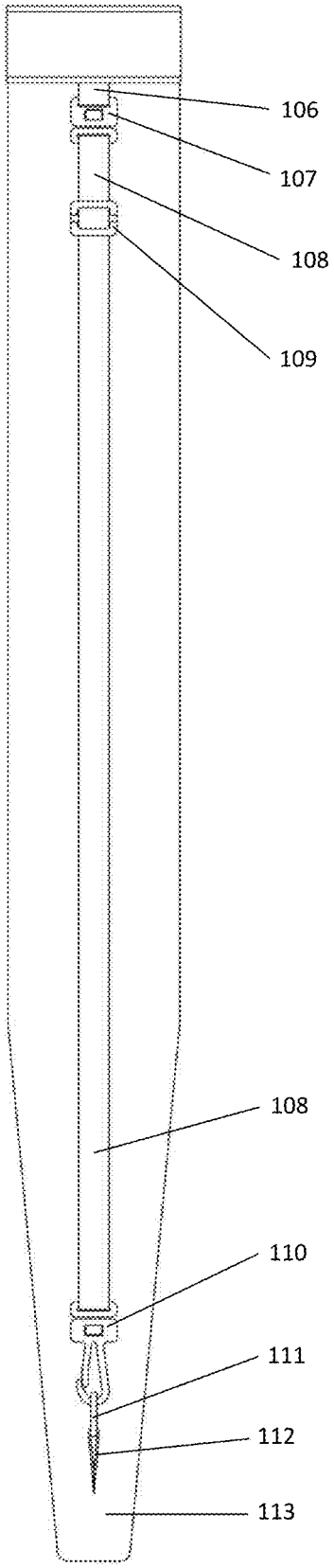
FIG. 5A depicts a rear view of one example of an Umbrella Bag with all its visible elements according to various embodiments of the present invention.
Figure 5B:
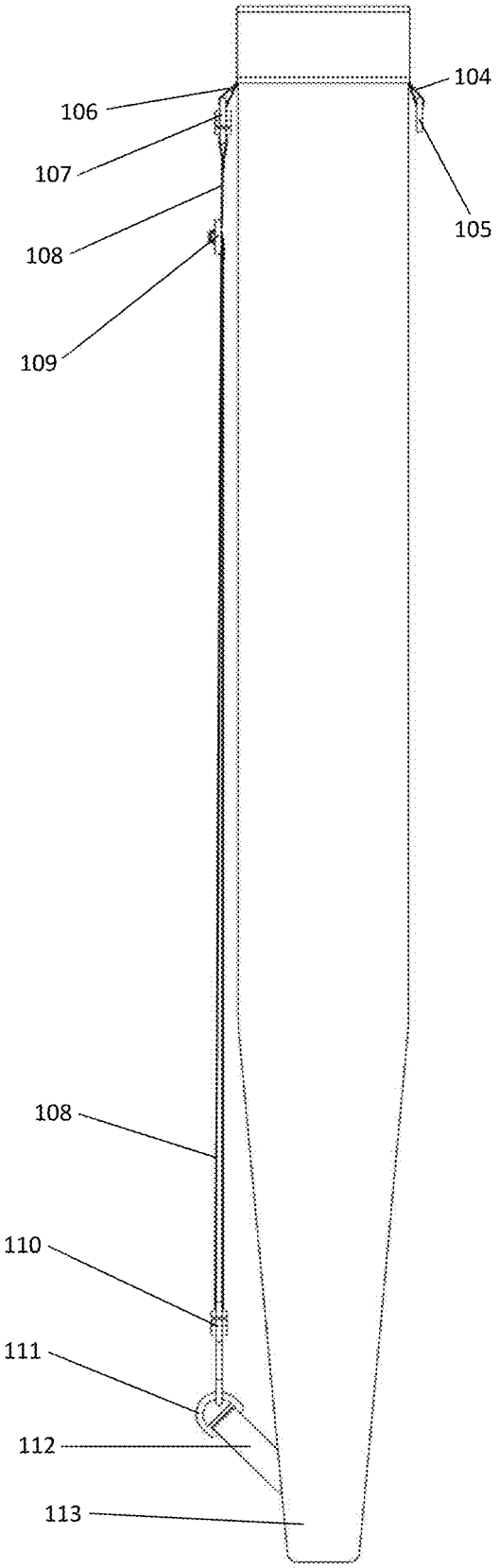
FIG. 5B depicts a side view of one example of an Umbrella Bag with all its visible elements according to various embodiments of the present invention.

In preferred embodiments, the Bottom Seam (102) supports two fixed straps, the Front Strap (104, FIG. 2) and the Rear Strap (106, FIG. 5A). The Front Strap (104) and the Rear Strap (106) are situated diametrically opposed to each other, on the front and the back sides of the Bag respectively, as shown in FIG. 5B. The Front Strap (104) holds the Front D-Ring Buckle (105, FIG. 2). The Rear Strap (106) holds a Double End Swivel Buckle (107, FIG. 5A).

The lower end of the Double End Swivel Buckle (107) is connected to an Adjustable Strap (108, FIG. 5A), whose length can be adjusted by a Triglide Slide Buckle (109, FIG. 5A) allowing the user to carry the Bag safely and comfortably. The lower end of the Adjustable Strap (108) holds a Swivel Hook (110, FIG. 5A) which can be anchored to a Lower D-Ring Buckle (111, FIG. 5B). This Lower D-Ring Buckle (111) is held by a Lower Strap (112, FIG. 5B) that is seamed to the Outer Sleeve (113, FIG. 5B) near to its bottom.

Figure 6:
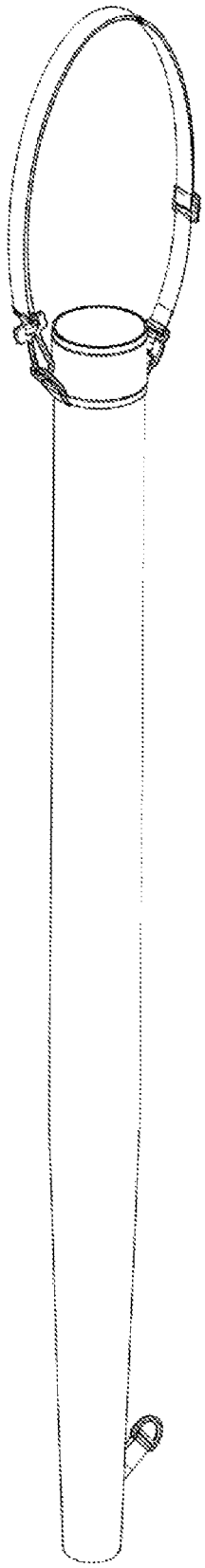
FIG. 6 depicts a perspective view of one example of an Umbrella Bag with an alternative strap positioning according to various embodiments of the present invention.

The Swivel Hook (110) can be disconnected from the Lower D-Ring Buckle (111) and connected to the Front D-Ring Buckle (105), positioning the Adjustable Strap (108) in a handle type fashion above the Bag's entrance as shown in FIG. 6, so that the user can carry the Bag hanging from the shoulder or in some other way.

In other embodiments of this invention, the Front D-Ring Buckle (105) and the Lower D-Ring Buckle (111) may be of a shape different than a D-Ring, as long as they allow easy anchoring and un-anchoring of the Swivel Hook (110).

The buckles may be made of plastic, non-ferrous metals, alloys, composites, or other water-resistant material. The straps may be made of polyester, polypropylene, or other flexible, water-resistant material.

In the particular embodiment described herein, the lower end of the Inner Sleeve (115) is affixed inside the Water Collector (116, FIG. 3) by means of a Snap Ring (117, FIG. 3), but other embodiments of this invention may use different methods of attachment. For example, the Inner Sleeve (115) can be glued inside the Water Collector (116) or be infused inside the walls of the Water Collector (116) during manufacturing.

Figure 7A:
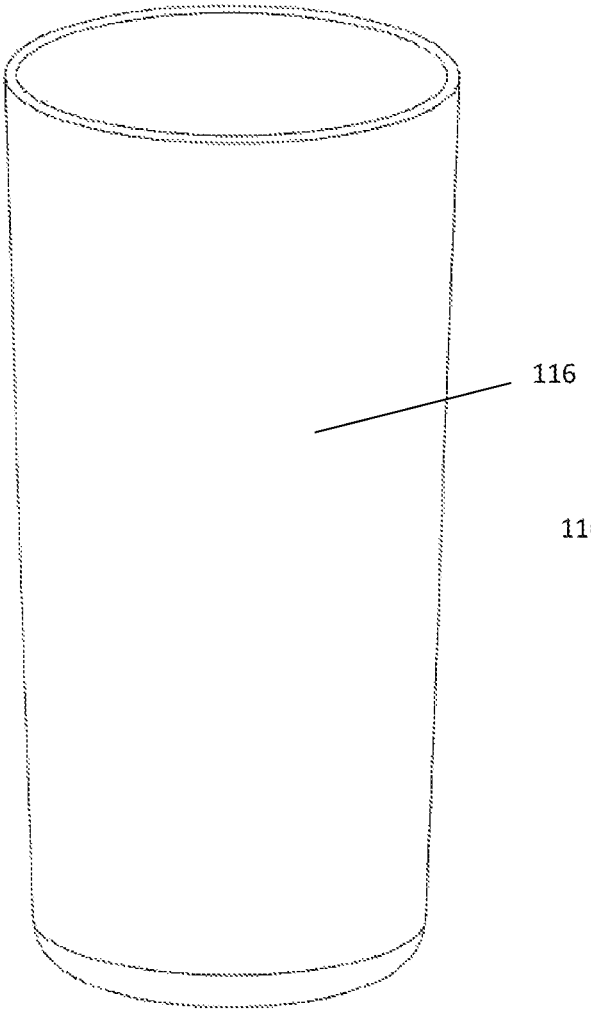
FIG. 7A depicts a perspective view of one example of a Water Collector according to various embodiments of the present invention.
Figure 7B:
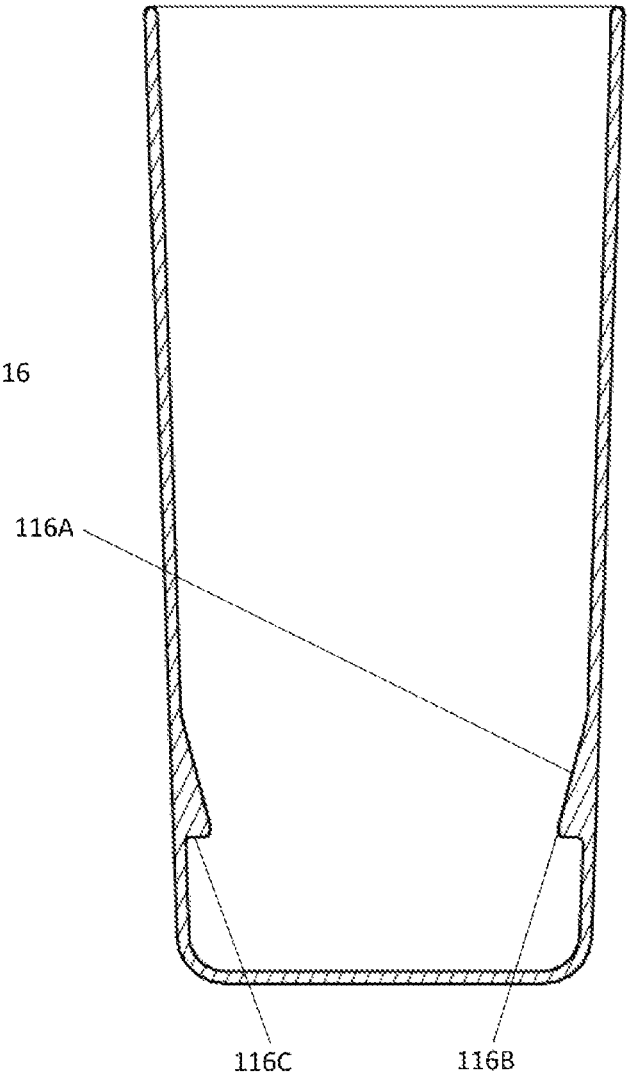
FIG. 7B depicts a section view of one example of a Water Collector according to various embodiments of the present invention.
Figure 8:
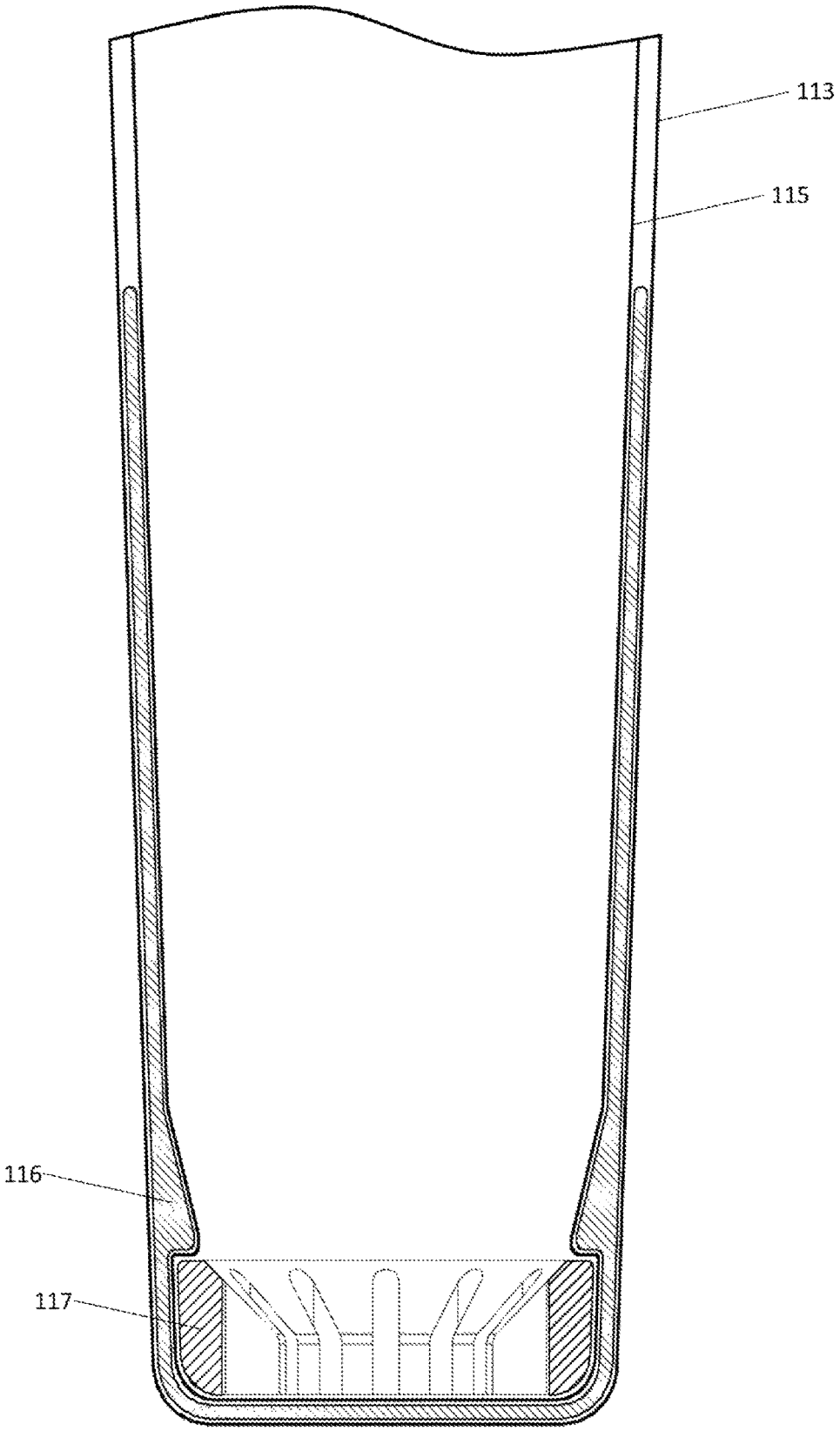
FIG. 8 depicts a section view of one example of the assembly of a Water Collector, Snap Ring, Inner Sleeve and Outer Sleeve according to various embodiments of the present invention.

In preferred embodiments of this invention, when the Snap Ring (117) is put on the bottom of the Inner Sleeve (115), and both are pushed inside the Water Collector (116), the Conical Mounting Wall (116A, FIG. 7B), compresses the Snap Ring (117) until it passes through the Retainer Neck (116B, FIG. 7B). Once on the bottom of the Water Collector (116), the Snap Ring (117) expands and holds the Inner Sleeve (115) in place by means of the Retainer Face (116C, FIG. 7B) that prevents the Snap Ring (117) and the Inner Sleeve (115) from coming off the Water Collector (116). A detailed section view of the assembly of the Water Collector (116), the Snap Ring (117), the Inner Sleeve (115) and the Outer Sleeve (113) is shown in FIG. 8.

Figure 9A:
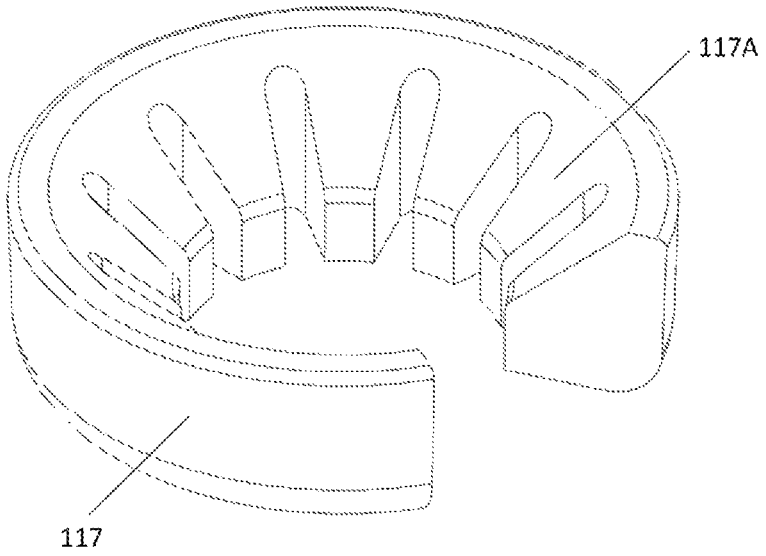
FIG. 9A depicts a perspective view of one example of a Snap Ring according to various embodiments of the present invention.
Figure 9B:
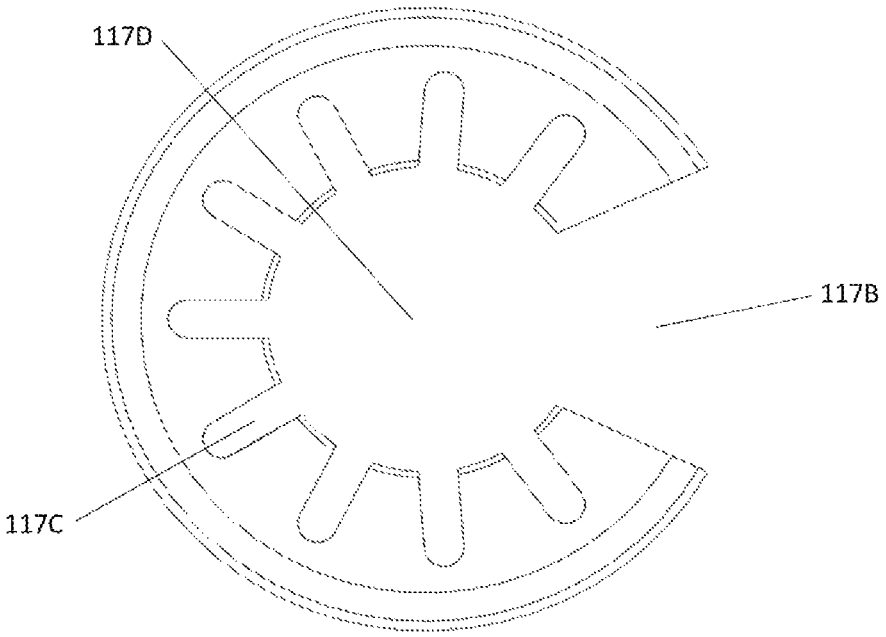
FIG. 9B depicts a top view of one example of a Snap Ring according to various embodiments of the present invention.
Figure 10:
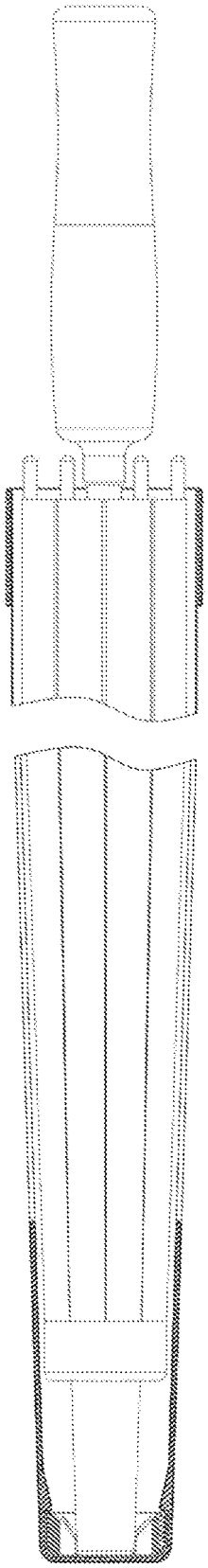
FIG. 10 depicts a partial section view of one example of an umbrella inside the Umbrella Bag according to various embodiments of the present invention.

The Snap Ring (117) can be compressed thanks to its Radial Opening (117B, FIG. 9B) and to its Radial Grooves (117C, FIG. 9B) that allow the Snap Ring (117) to be flexible. On the top face, the Snap Ring (117) has a conical profile (the "Tip Guide", 117A, FIG. 9A) that guides the tip of the umbrella towards the center of the Snap Ring (117) when the umbrella is introduced into the Bag. When the umbrella is fully inserted in the Bag, the Snap Ring (117) houses the tip of the umbrella in the Tip Niche (117D, FIG. 9B) keeping the umbrella centered on the bottom of the Water Collector (116). Both the Radial Grooves (117C) and the Tip Niche (117D) expose part of the bottom surface of the Inner Sleeve (115) to the air, helping the Inner Sleeve (115) to dry. One example of an umbrella inside the Bag is shown in FIG. 10.

The Water Collector (116) has the following additional functionalities: (i) gives support to the Inner Sleeve (115) and protects the Outer Sleeve (113) so that the tip of the umbrella cannot pierce them. (ii) provides a defined shape to the bottom of the Bag, (iii) aids the user turn the Inner Sleeve (115) inside out to facilitate drying and (iv) aids the user push the Inner Sleeve (115), once dried, to its normal position inside the Outer Sleeve (113).

The Water Collector (116) and the Snap Ring (117) may be made of plastic, non-ferrous metals, alloys, composites, or other water-resistant material.

While preferred materials for each element have been described, the Bag described herein is not limited by these materials. Plastics, rubber, fabrics, foam, metal alloys, aluminum, and other materials may comprise some or all of the elements of the Bag in various embodiments of the present invention.

An important version of the invention can be fairly described as an umbrella bag for holding, carrying and storing an umbrella comprising, among other features, an outer sleeve, an inner sleeve, a collector and a strap. The outer sleeve has an open first end, a closed second end and a tubular medial segment between the ends of the outer sleeve. The inner sleeve has an open first end, a closed second end and a tubular medial segment between the ends of the inner sleeve. The inner sleeve and the outer sleeve are substantially the same length. The inner sleeve may be slightly shorter so that it can fit inside the outer sleeve. The inner sleeve is dimensioned to contain a preselected closed umbrella, such as a common rain umbrella. A collar is affixed to the outer sleeve first end and the collar maintains the outer sleeve first end substantially circularly open, so the interior of the inner sleeve is accessible for placement of the umbrella. The inner sleeve first end is affixed to the outer sleeve first end. The inner sleeve is disposed within the outer sleeve, being essentially a liner for the outer sleeve. The inner sleeve is water-resistant to contain the moisture of the wet umbrella. A first attachment point (for example a D ring or clip point) is affixed to an exterior of the outer sleeve first end at a back side. A second attachment point is affixed to the exterior of the outer sleeve first end at a front side. A third attachment point is affixed to an exterior of the outer sleeve second end at a back side. In an alternate version of the design there is only one attachment point at each end of the outer sleeve. A first end of the strap connects to the first attachment point and a second end of the strap selectively connects to any one of: the second attachment point or the third attachment point. In an alternate version of the device both the first end and the second end of the strap connect to a single attachment point near the open end of the outer sleeve. The collector has an interior volume bounded by an open first end and a closed second end. Generally, the collector can hold a volume of water shed from a wet umbrella inside the device. The collector is attached to the second end of the inner sleeve. Optionally, the closed umbrella having a canopy between a tip end and a handle end wherein the tip end of the closed umbrella is inserted through the collar and into the inner sleeve and the tip end is seated into a guide affixed inside the collector concentric with the collector and the canopy is entirely within the inner sleeve. Optionally, the guide includes one or more vents to aid evaporation of moisture in the collector. Optionally, the outer sleeve is water-resistant or waterproof to keep moisture from the umbrella inside the inner sleeve and thereby keeping the user dry. Optionally, the strap has an adjustable length.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are contemplated thereby.

What is claimed is:

1. An umbrella bag comprising an outer sleeve, an inner sleeve, a collector and a strap;

the outer sleeve has an open first end, a closed second end and a tubular medial segment;

the inner sleeve has an open first end, a closed second end and a tubular medial segment;

the inner sleeve and the outer sleeve are substantially the same length;

the inner sleeve is dimensioned to contain a preselected closed umbrella;

a collar is affixed to the outer sleeve first end;

the collar maintains the outer sleeve first end substantially circularly open;

the inner sleeve first end is affixed to the outer sleeve first end;

the inner sleeve is disposed within the outer sleeve;

the inner sleeve is water-resistant;

a first attachment point is affixed to an exterior of the outer sleeve first end at a back side;

a second attachment point is affixed to the exterior of the outer sleeve first end at a front side;

a third attachment point is affixed to an exterior of the outer sleeve second end at a back side;

a first end of the strap connects to the first attachment point and a second end of the strap selectively connects to any one of: the second attachment point or the third attachment point;

the collector has an interior volume bounded by an open first end and a closed second end;

the collector is attached to the second end of the inner sleeve.

2. The umbrella bag of claim 1 further comprising the closed umbrella having a canopy between a tip end and a handle end wherein the tip end of the closed umbrella is inserted through the collar and into the inner sleeve and the tip end is seated into a guide affixed inside the collector concentric with the collector and the canopy is entirely within the inner sleeve.

3. The umbrella bag of claim 2 further characterized in that the guide includes vents to aid evaporation of moisture in the collector.

4. The umbrella bag of claim 1 further characterized in that the outer sleeve is water-resistant.

5. The umbrella bag of claim 1 further characterized in that the strap has an adjustable length.

* * * * *